US008122863B2

(12) United States Patent
Myers

(10) Patent No.: US 8,122,863 B2
(45) Date of Patent: Feb. 28, 2012

(54) CAMSHAFT PHASER FOR THE INNER CAMSHAFT OF A CONCENTRIC CAMSHAFT ASSEMBLY

(75) Inventor: Jesse Myers, Waterford, MI (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 338 days.

(21) Appl. No.: 12/566,091

(22) Filed: Sep. 24, 2009

(65) Prior Publication Data

US 2010/0089350 A1 Apr. 15, 2010

Related U.S. Application Data

(60) Provisional application No. 61/104,051, filed on Oct. 9, 2008.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,805,080 B2 10/2004 Golovatai-Schmidt et al.
2002/0059910 A1 * 5/2002 Methley et al. ..... 123/90.17

FOREIGN PATENT DOCUMENTS

DE 102006024793 11/2007

* cited by examiner

*Primary Examiner* — Zelalem Eshete
(74) *Attorney, Agent, or Firm* — Volpe and Koenig, P.C.

(57) ABSTRACT

A camshaft phaser assembly for a concentric camshaft that adjusts the relative rotational position of the inner camshaft relative to the outer camshaft and the crankshaft of an internal combustion engine is provided. The phaser has an inner rotor with radially outwardly extending vanes which is attached to the inner camshaft. The rotor is surrounded by a stator having radially inwardly directed projections which contact the outer surface of the rotor and form working spaces into which the vanes extend. The vanes divide the working spaces into first and second sets of pressure chambers which can be pressurized with a hydraulic medium in order to rotate the rotor in an advancing or retarding direction. Front and rear covers are attached to the stator and define the front and rear sides of the pressure chambers. The timing gear or timing belt pulley is connected to the stator. The rear cover includes a splined opening. The front end of the outer camshaft includes a splined connection complementary to the splined opening in order to provide a positive fit connection between the outer camshaft and the rear cover for direct transfer of the timing chain or belt loads into the outer camshaft.

6 Claims, 3 Drawing Sheets

CAMSHAFT PHASER FOR THE INNER CAMSHAFT OF A CONCENTRIC CAMSHAFT ASSEMBLY

CROSS-REFERENCE TO RELATED APPLICATIONS

This application claims the benefit of U.S. Provisional Application No. 61/104,051, filed Oct. 9, 2008, which is incorporated herein by reference as if fully set forth.

BACKGROUND

The invention relates to a camshaft phaser or adjuster for the inner camshaft of a concentric camshaft assembly, and in particular to a camshaft phaser or adjuster for adjusting the relative rotational angle position of an inner camshaft of a concentric camshaft assembly relative to the phase position of the outer camshaft and the crankshaft of an internal combustion engine.

Camshaft phasers that operate according to the vane-cell principle for use on single camshafts are known. These are described in publications by the assignee of the present invention, including U.S. Pat. No. 6,805,080, which is incorporated herein by reference as if fully set forth. These work well in connection with DOHC engines where all the intake or exhaust cam lobes are located on separately located intake and exhaust camshafts.

It has also been known to use camshaft phasers in connection with concentric camshaft assemblies for controlling the phase position of the inner camshaft, the outer camshaft or both. One such arrangement is described in DE 10 2006 024 793 A1. This publication discloses a dual phasing system for a concentric camshaft assembly which includes two camshaft phasers which are located at the front of an engine that are axially spaced adjacent to one another. These two camshaft phasers allow independent control the rotation angle of the outer and inner co-axial camshafts relative to the crankshaft in order to allow separate adjustment of the timing of the intake and the exhaust valves of the internal combustion engine. However, this arrangement provides additional complexity which is often not required to obtain many of the benefits of adjusting either the inner or the outer camshafts of a concentric camshaft assembly without the need for adjusting both.

A problem with the known camshaft phasers for use with either or both the inner and outer camshafts of a concentric camshaft assembly is that the chain or belt loads from the timing chain or belt are transmitted to the inner camshaft. This can cause bending and binding of the inner camshaft relative to the tubular outer camshaft. Additionally, in the prior known systems, the phaser is formed with opposing vanes extending from the front and rear covers of the phaser, toward one another, with one of the covers being attached to the inner shaft and the other cover being attached to the outer shaft. This arrangement has been shown to lack durability and includes basic design flaws which affect the functionality of such proposed systems.

It would be desirable to provide a camshaft phaser for a concentric camshaft assembly that allows for phasing of either the intake or exhaust lobes of a camshaft in which the drive load from the timing chain or belt extending from the crankshaft to the timing gear or timing belt pulley of the concentric camshaft arrangement is transmitted to the outer shaft of the concentric camshaft. Additionally, it would be desirable to provide the phaser as a preassembled unit which can be installed in a simple manner during assembly of the engine, minimizing the complexity of the assembly steps required. Further, the phaser should be removable as a single unit for service so that it can be easily removed and installed in the field.

SUMMARY

The present invention provides a camshaft phaser for the inner camshaft of a concentric camshaft assembly in an internal combustion engine which addresses the deficiencies in the known arrangements.

In the preferred embodiment of the invention, the camshaft phaser or adjuster for the inner camshaft of a concentric camshaft assembly comprises a vane-cell type phaser assembly of the type disclosed in the assignee's U.S. Pat. No. 6,805,080 for use in connection with single camshafts. The phaser assembly of the present invention includes an inner rotor with radially outwardly extending vanes which is attached to the inner camshaft. The rotor is surrounded by a stator having radially inwardly directed projections which contact the outer surface of the rotor and form working spaces into which the vanes extend. The vanes divide the working spaces into first and second sets of pressure chambers which can be pressurized with a hydraulic medium in order to rotate the rotor in an advancing or retarding direction relative to the stator. Front and rear covers are attached to the stator and define the front and rear sides of the pressure chambers. The timing gear or timing belt pulley is also attached to the stator. In order to transfer the loads caused by the timing chain or belt directly into the outer camshaft, the rear cover includes a splined opening. The front end of the outer camshaft includes a splined connection complementary to the splined opening in order to provide a positive fit connection between the outer camshaft and the rear cover for direct transfer of the timing chain or belt loads into the outer camshaft. In a preferred embodiment, the first camshaft journal of the outer camshaft is located directly adjacent to the splined connection.

Preferably, the rotor is connected to the inner camshaft via a central bolt assembly that includes a central bore in which a valve assembly is located for controlling the flow of pressurized hydraulic medium to the pressure chambers used to rotate the inner rotor relative to the stator. In a preferred embodiment, the valve assembly is a solenoid driven spool valve which directs pressurized hydraulic medium to either or both sets of pressure chambers between the stator and the rotor to either advance or retard the rotor with the attached inner camshaft relative to the stator (which is connected to the outer camshaft and the crankshaft) and/or to hydraulically fix the position of the rotor relative to the stator.

In a preferred embodiment, a locking pin is provided in the rotor to engage the front cover, rear cover or stator in a base position of the inner camshaft when insufficient pressurized hydraulic medium is available for maintaining sufficient control of the position of the rotor relative to the stator.

It is further preferred if a helical spring is connected between the rotor and the stator to balance the force required for rotating the rotor in an advancing direction relative to the stator in comparison to the force required for retarding the position of the rotor relative to the stator.

Further aspects of the invention, which can be used alone or in combination, are described in detail below.

BRIEF DESCRIPTION OF THE DRAWINGS

The foregoing summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
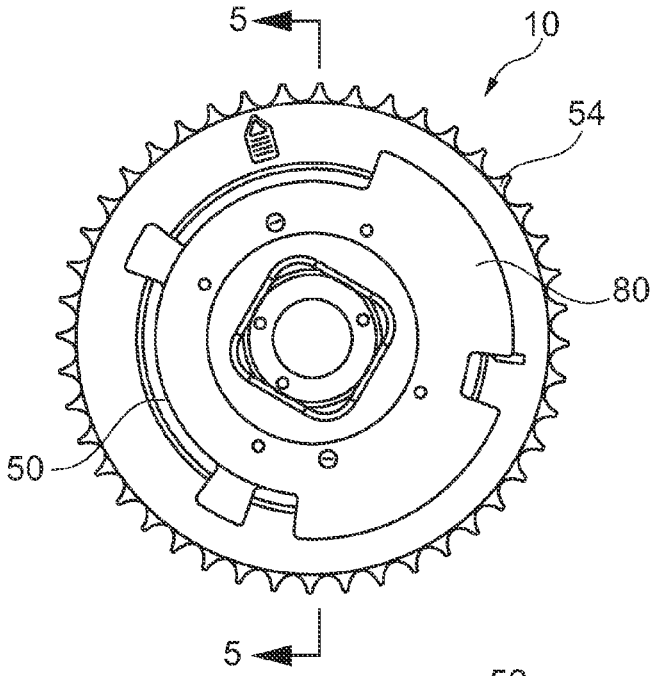
FIG. 1 is a front elevational view of a camshaft phaser assembly according to the present invention.
Figure 2:
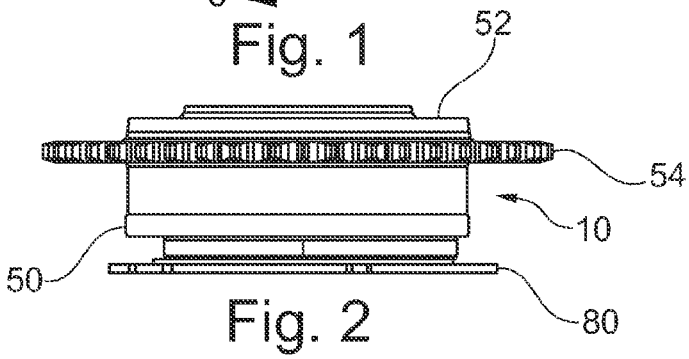
FIG. 2 is a top view of the camshaft phaser assembly shown in FIG. 1.

Certain terminology is used in the following description for convenience only and is not limiting. The words "front," "rear," "upper" and "lower" designate directions in the drawings to which reference is made. The words "inwardly" and "outwardly" refer to the directions toward and away from the parts referenced in the drawings. A reference to a list of items that are cited as "at least one of a, b or c" (where a, b and c represent the items being listed) means any single one of the items a, b or c, or combinations thereof. The terms camshaft "phaser" and "adjuster" are used interchangeably. The terminology includes the words specifically noted above, derivatives thereof and words of similar import.

Referring to FIG. 1-6, a camshaft phaser 10 for a concentric camshaft assembly 12 is shown. The concentric camshaft assembly 12, which is shown in detail in FIG. 4, preferably includes the inner shaft 14 having a front end, with a central bolt receiving hole 16, oil feed passages 18 and a timing pin bore 19, that protrudes from the front end of the outer tubular shaft 22, which has a splined connection 24 located at the front end adjacent to the first bearing journal 26. Those skilled in the art will understand that both the inner and outer camshafts include cam lobes, with the cam lobes of the inner camshaft protruding through openings in the outer tubular camshaft. One of the inner camshaft or the outer camshaft is used to control the opening of the intake valves of an internal combustion engine, and the other is used to control the opening of the exhaust valves.

Figure 5:
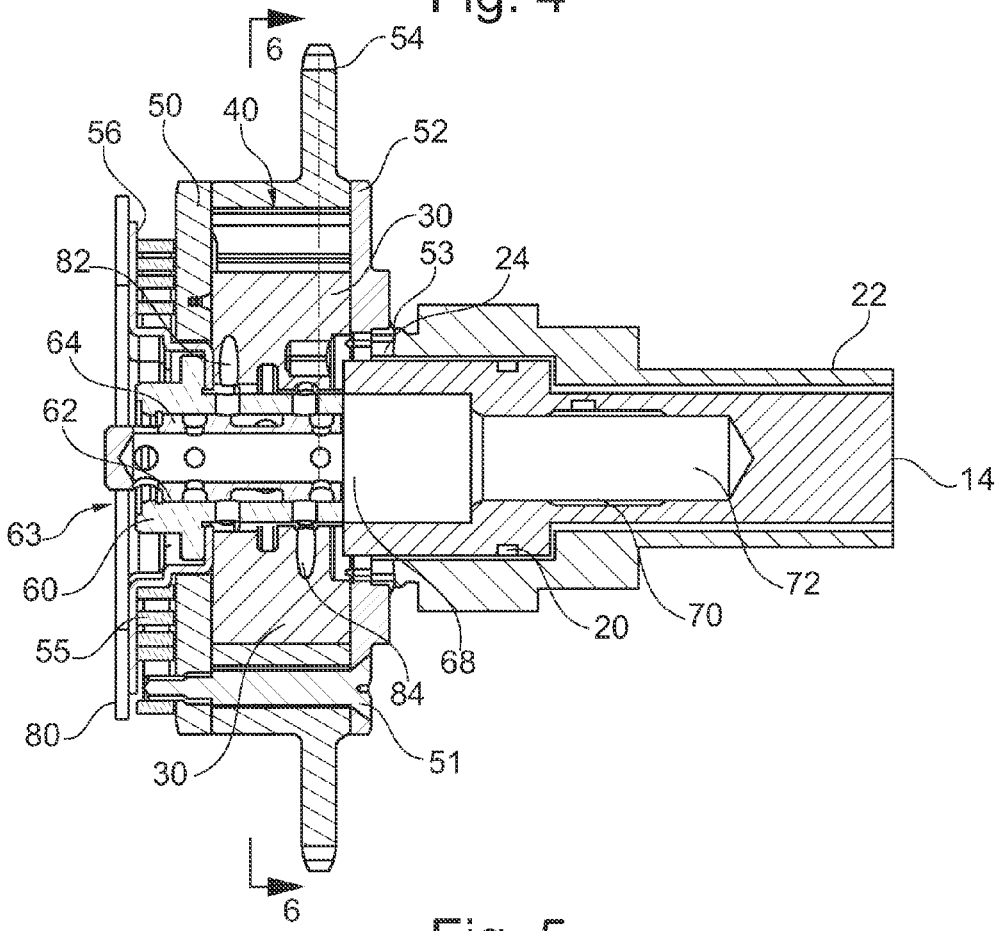
FIG. 5 is a cross-sectional view through the camshaft phaser of FIG. 1 and the front of the concentric camshaft assembly taken along lines 5-5 in FIG. 1.
Figure 6:
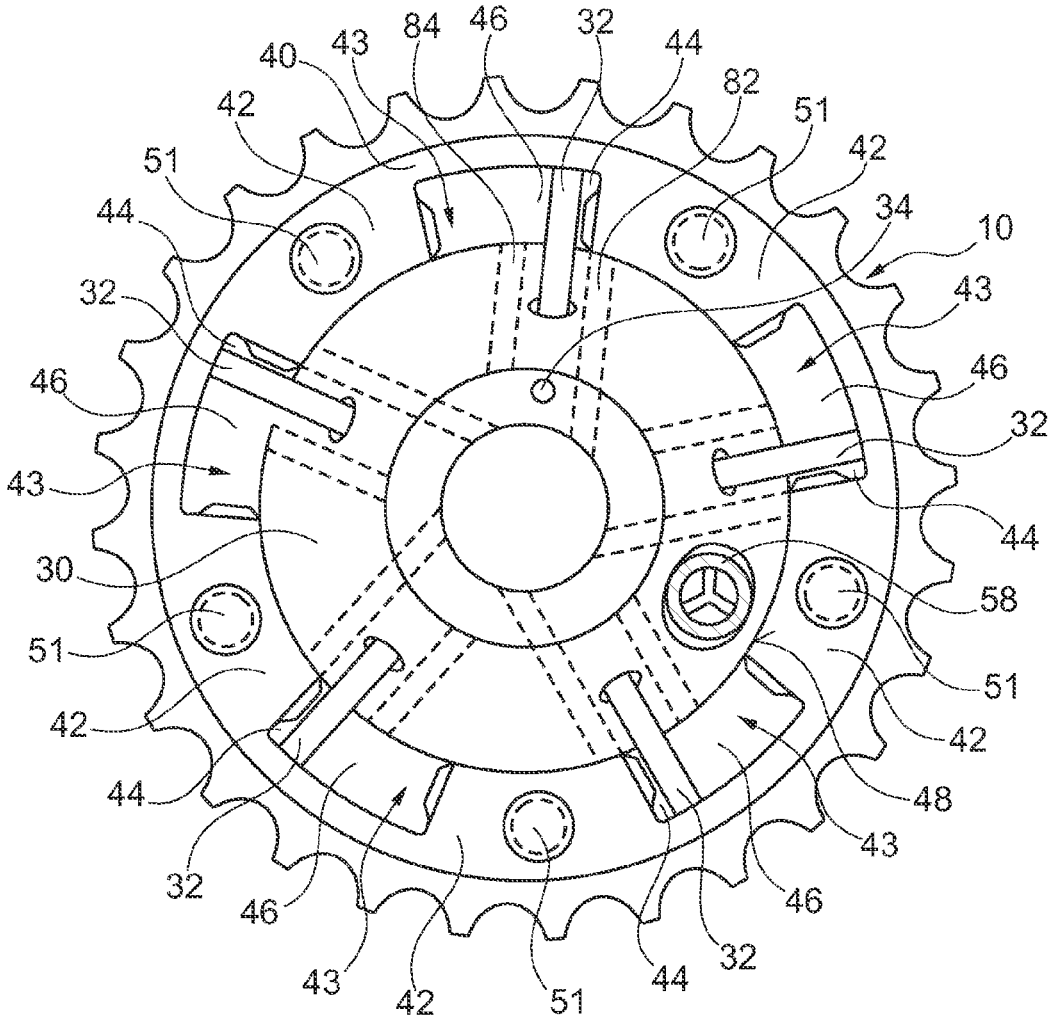
FIG. 6 is a cross-sectional view through the camshaft phaser taken along line 6-6 in FIG. 5.

As shown in detail in FIGS. 5 and 6, the camshaft phaser 10 includes a rotor 30 having radially outwardly directed vanes 32. The rotor 30 is located inside a stator 40 which includes radially inwardly directed projections 42. These projections 42 include bearing surfaces 48 which slidingly engage the outer surface of the rotor 30 at positions between the vanes 32. The vanes 32 extend into working spaces 43 defined between the projections 42 to divide the working spaces 43 into a first set of chambers 44 and a second set of chambers 46. The front and rear walls of these chambers are defined by a front cover 50 and a rear cover 52. The front and rear covers 50, 52 are connected to the stator 40 via bolts 51.

Preferably, a locking pin 58 is located within the rotor 30 and is of the type described in U.S. Pat. No. 6,805,080, and is spring biased into a position in which it engages in a corresponding recess located in the front cover 50. The recess is connected to a source of pressurized hydraulic medium such that when sufficient pressurized hydraulic medium is available for stable operation of the phaser 10, the locking pin 58 is disengaged from the recess 59 allowing the rotor 30 to move from the base position in order to advance or retard the timing of the inner camshaft 14 relative to the outer camshaft 22 and the crankshaft (not shown) of the internal combustion engine.

As shown in the Figures, a timing gear 54 is located on or connected to the stator and is connected to the crankshaft of the internal combustion engine via a timing chain (not shown). Alternatively, instead of a timing gear 54, a timing belt pulley could also be provided or any other suitable drive could be utilized for transferring the rotating motion of the crankshaft to the camshaft phaser 10. The timing gear 54 could alternatively be formed on or connected to the front or rear covers 50, 52.

Figure 3:
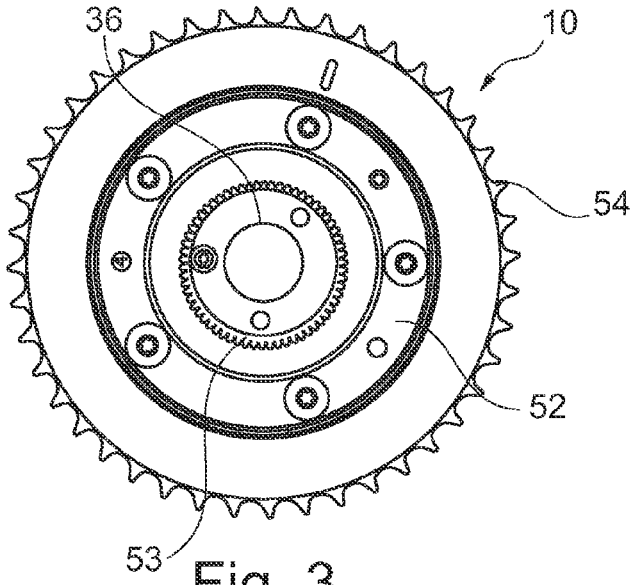
FIG. 3 is a rear elevational view of the camshaft phaser assembly of FIG. 1.
Figure 4:
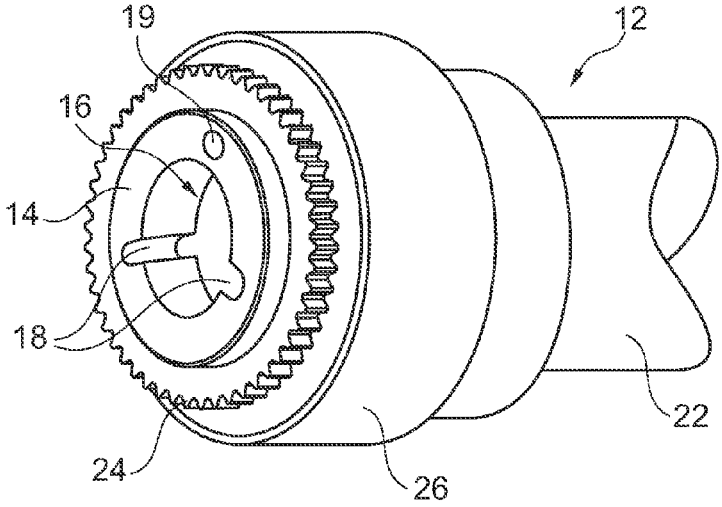
FIG. 4 is a front perspective view of the concentric camshaft assembly showing the inner camshaft and the outer camshaft.

As shown in detail in FIGS. 3 and 4, the rear cover 52 shown in FIG. 3 includes a splined opening 53 in which the splined end 24 at the front of the outer camshaft 22 engages. This splined connection provides for a direction transfer of the radial loads created by the timing chain or timing belt acting on the timing gear 54 or pulley located on the stator 40 to the outer camshaft 22. This arrangement prevents these radial loads from being introduced into the inner camshaft 14 in order to prevent bending and/or binding of the inner camshaft 14.

Referring again to FIG. 5, the rotor 30 is connected to the inner camshaft 14 via central bolt assembly 60 which clamps the rotor 30 to the inner camshaft 14. Preferably, a timing pin is placed in the timing pin bore 19 of the inner camshaft 14 and is received in a corresponding bore in the rotor 30 in order to set a desired fixed position between the inner camshaft 14 and the rotor 30. Alternatively, the timing between the outer camshaft 22 and the inner camshaft 14 can be controlled within the camshaft assembly, or it can be established when assembling the engine, for example by engaging a tool at the rear of the camshaft assembly in alignment slots on the inner and outer camshafts 14, 22.

As shown in detail in FIG. 5, the central bolt assembly 60 includes a valve assembly 63 for directing pressurized hydraulic fluid to the first set of chamber 44 for rotating the rotor 30 in an advancing direction relative to the stator 40 in order to advance the timing of the inner camshaft 14, or to the second set of chambers 46 in order to rotate the rotor 30 in a direction to retard the timing of the inner camshaft 14. Hydraulic fluid can be applied to both the first and second sets of chambers 44, 46 in order to hydraulically lock the rotor 30 in a generally fixed position relative to the stator 40. An electromagnetic solenoid (not shown) is used in order to adjust the position of the valve spool 64 within the inner bore 62 to direct pressurized hydraulic fluid to the passages 82, 84 as required. The valve spool 64 is biased to an initial position via a spring 68 which rests on a shoulder within the central bolt assembly 60. Preferably, pressurized hydraulic fluid is provided to the central bolt assembly 60 via pressurized hydraulic fluid being delivered in the space between the inner camshaft 14 and the outer camshaft 22 of the concentric camshaft assembly 12. This travels past a check valve 22 and through a filter 70 of the central bolt assembly 60 prior to reaching the valve spool 64 which directs the pressurized hydraulic fluid to the passages 82, 84 or to a drain back to the engine oil reservoir.

As shown in FIG. 5, a helical spring 55 acts between the stator 40, via two of the five assembly bolts 51 (see FIG. 5) that engage the spring 55, and the rotor 30, via a spring cover 56 that is attached to the spring 55 and extends through a clearance hole in the front cover 50 and is clamped to the rotor 30 using the bolt assembly 60. The spring 55 balances the hydraulic force required to rotate the rotor 30 in a direction to advance the timing of the inner camshaft 14 in comparison to the force required to rotate the rotor 30 in a direction to retard the timing of the inner camshaft 14.

As shown in FIGS. 1 and 5, a timing sensor plate 80 is connected to the front of the camshaft phaser 10 and, by the use of a position sensor (not shown) allows the position of the rotor 30 to be determined so that the timing position of the rotor 30 and the inner camshaft 14 can be accurately controlled using an engine control module (not shown) which controls the valve assembly 63.

The camshaft phaser 10 is preassembled as a unit that can be installed in one piece of the front end of the concentric camshaft assembly 12 by aligning the rotor 30 with the inner camshaft 14 so that the timing bin bore 19 and timing pin located therein align with the corresponding timing pin bore 34 in the rotor 30, and sliding the splined end 24 of the outer camshaft 22 into the splined opening 53 in the rear cover 52 attached to the stator. The central bolt assembly 60 is then used to clamp the rotor 30 to the inner camshaft 14 and holds the entire phaser 10 in position axially on the front end of the concentric camshaft assembly 12.

The camshaft phaser 10 for the inner camshaft 14 of the concentric camshaft assembly 12 provides all the advantages of the known phasers for single camshafts and addresses the drawbacks of the known camshaft phasers which have been suggested for use in connection with the inner camshaft of a concentric camshaft assembly. Specifically, by providing a splined connection between the outer camshaft and the timing gear or timing belt pulley, the loads from the timing belt or chain are transferred directly via the stator 40 and the rear cover plate 52 into the outer camshaft 22 thus preventing potential binding of the inner camshaft 14 which can occur in the known prior art arrangements. Thus all the advantages of a conventional vane-cell type camshaft phaser which was known for use in connection with single camshafts can now be utilized to control the inner camshaft 14 of a concentric camshaft assembly 12 in a stable and reliable manner. Additionally, by providing the camshaft phaser 10 as a unitized assembly which is attached using the central bolt 60 to the inner camshaft and via the splined connection between the outer camshaft 22 and the rear cover 52, the camshaft phaser 10 according to the invention can be easily installed and removed during assembly and for service of the engine and/or camshaft phaser 10.

What is claimed is:

1. A camshaft phaser assembly for a concentric camshaft that adjusts the relative rotational position of an inner camshaft relative to an outer camshaft and a crankshaft of an internal combustion engine, the phaser assembly comprising:

an inner rotor with radially outwardly extending vanes which is attached to the inner camshaft;

a stator having radially inwardly directed projections which contact the outer surface of the rotor and form working spaces into which the vanes extend, the vanes divide the working spaces into first and second sets of pressure chambers which can be pressurized with a hydraulic medium in order to rotate the rotor in an advancing or retarding direction;

front and rear covers attached to the stator which define front and rear sides of the pressure chambers;

a timing gear or timing belt pulley connected to the stator; and the rear cover includes a splined opening and a front end of the outer camshaft includes a splined connection complementary to the splined opening in order to provide a positive fit connection between the outer camshaft and the rear cover for direct transfer of the timing chain or belt loads into the outer camshaft.

2. The camshaft phaser assembly of claim 1, wherein the rotor is connected to the inner camshaft with a central bolt assembly which includes a pressurized hydraulic fluid control valve.

3. The camshaft phaser assembly of claim 1, wherein a hydraulic fluid filter is located in the central bolt assembly.

4. The camshaft phaser assembly of claim 1, wherein a front end of the inner camshaft includes a timing pin bore and the rotor includes a corresponding timing pin bore.

5. The camshaft phaser assembly of claim 1, further comprising a balance spring connected between the rotor and the stator that equalizes advancing and retarding adjustment forces.

6. The camshaft phaser assembly of claim 5, wherein the balance spring is connected to the stator by at least one of the axially extending assembly bolts that connect the front and rear covers to the stator.

* * * * *